US012181237B2

(12) United States Patent
Muska

(10) Patent No.: US 12,181,237 B2
(45) Date of Patent: Dec. 31, 2024

(54) TRIGGER RETURN AND SAFETY MECHANISM

(71) Applicant: Smith & Wesson Inc., Springfield, MA (US)

(72) Inventor: Simon M. Muska, Enfield, CT (US)

(73) Assignee: Smith & Wesson Inc., Springfield, MA (US)

( * ) Notice: Subject to any disclaimer, the term of this patent is extended or adjusted under 35 U.S.C. 154(b) by 0 days.

(21) Appl. No.: 18/159,717

(22) Filed: Jan. 26, 2023

(65) Prior Publication Data

US 2023/0235982 A1 Jul. 27, 2023

Related U.S. Application Data

(60) Provisional application No. 63/303,617, filed on Jan. 27, 2022.

(51) Int. Cl.
*F41A 19/10* (2006.01)
*F41A 17/46* (2006.01)

(52) U.S. Cl.
CPC ..... *F41A 19/10* (2013.01); *F41A 17/46* (2013.01)

(58) Field of Classification Search
CPC ..... F41A 19/10; F41A 17/46
USPC ..... 42/69.01–69.3, 70.01, 70.06
See application file for complete search history.

(56) References Cited

U.S. PATENT DOCUMENTS

| | | | | |
|---|---|---|---|---|
| 2,453,683 A | | 1/1948 | Caldow | |
| 2,538,940 A | | 1/1951 | Henckel | |
| 2,571,132 A | | 10/1951 | Harvey | |
| 3,415,000 A | | 12/1968 | Koucky et al. | |
| 3,577,668 A | | 5/1971 | Ruger | |
| 3,707,796 A | | 1/1973 | Bielfeldt | |
| 4,056,038 A | | 11/1977 | Rath | |
| 4,067,131 A | * | 1/1978 | Ruger | F41A 19/53 42/69.01 |
| 4,123,963 A | * | 11/1978 | Junker | F41A 15/20 102/431 |
| 4,133,128 A | | 1/1979 | Brush | |
| 5,287,642 A | | 2/1994 | Scaramucci | |
| 5,513,460 A | | 5/1996 | Van Niekerk et al. | |
| 5,924,231 A | | 7/1999 | Kidd | |
| 6,347,474 B1 | * | 2/2002 | Wolff, Jr. | F41A 19/10 42/69.01 |
| 8,117,957 B2 | | 2/2012 | Loganchuk | |
| 10,989,490 B2 | | 4/2021 | Dunham | |
| 2021/0270556 A1 | | 9/2021 | Biegel | |

* cited by examiner

*Primary Examiner* — Reginald S Tillman, Jr.

(74) *Attorney, Agent, or Firm* — Ballard Spahr LLP

(57) ABSTRACT

A trigger return and safety mechanism are mountable on a frame of a firearm. The trigger is mountable on the frame and pivotable about a trigger pivot axis. A strut is pivotably attached to the trigger at a strut pivot axis oriented parallel to and offset from the trigger pivot axis. The strut comprises a spring bearing surface and a safety bearing surface. A spring acts between the spring bearing surface and the frame for biasing the trigger into a reset position after the trigger has been pulled. A body is mountable on the frame, the body being movable between a first position wherein the body is not engageable with the safety bearing surface, thereby allowing pivoting motion of the trigger, and a second position wherein the body is engageable with the safety bearing surface thereby limiting pivoting motion of the trigger.

10 Claims, 3 Drawing Sheets

TRIGGER RETURN AND SAFETY MECHANISM

CROSS-REFERENCE TO RELATED APPLICATION

This application claims priority to and the benefit of the filing date of U.S. Provisional Patent Application No. 63/303,617, filed Jan. 27, 2022, the entirety of which is hereby incorporated by reference herein.

FIELD

This invention relates to trigger return and safety mechanisms for firearms.

BACKGROUND

The disposition of the various mechanisms within the frame of a firearm presents challenges, especially when long guns such as carbines are designed for use with sub-caliber (pistol) ammunition. Many factors must be taken into account to ensure a successful firearm, especially when ergonomics are considered important. There is clearly an opportunity to improve firearm design as it relates to mechanisms for trigger return and safety which improve the internal layout of the mechanisms which compete for space in the firearm frame.

SUMMARY OF EMBODIMENTS

In combination, a trigger return and safety mechanism are mountable on a frame of a firearm. Said combination comprises a trigger mountable on said frame and pivotable about a trigger pivot axis. A strut is pivotably attached to said trigger at a strut pivot axis oriented parallel to and offset from said trigger pivot axis. The strut comprises a spring bearing surface and a safety bearing surface. A spring acts between said spring bearing surface and said frame for biasing said trigger into a reset position after said trigger has been pulled. A body is mountable on said frame, said body being movable between a first position wherein said body is not engageable with said safety bearing surface, thereby allowing pivoting motion of said trigger, and a second position wherein said body is engageable with said safety bearing surface thereby limiting pivoting motion of said trigger.

In some embodiments, said spring, said safety bearing surface and said body are positionable within said frame between said trigger and a muzzle end of said firearm.

A trigger return mechanism is mountable on a frame of a firearm. Said trigger return mechanism comprises a trigger mountable on said frame and pivotable about a trigger pivot axis. A strut positionable is on said frame and pivotably attached to said trigger at a strut pivot axis oriented parallel to and offset from said trigger pivot axis. The strut comprises a spring bearing surface. A spring acts between said spring bearing surface and said frame for biasing said trigger into a reset position after said trigger has been pulled.

In some exemplary embodiments, the strut comprises a safety bearing surface. A body is mountable on said frame, said body being movable between a first position wherein said body is not engageable with said safety bearing surface, thereby allowing pivoting motion of said trigger, and a second position wherein said body is engageable with said safety bearing surface thereby limiting pivoting motion of said trigger.

A trigger safety mechanism is mountable on a frame of a firearm. Said trigger safety mechanism comprises a trigger mountable on said frame and pivotable about a trigger pivot axis. A strut is pivotably attached to said trigger at a strut pivot axis oriented parallel to and offset from said trigger pivot axis. The strut comprises a safety bearing surface. A body is mountable on said frame, said body being movable between a first position wherein said body is not engageable with said safety bearing surface, thereby allowing pivoting motion of said trigger, and a second position wherein said body is engageable with said safety bearing surface thereby limiting pivoting motion of said trigger.

In some aspects, the strut comprises a spring bearing surface. A spring acts between said spring bearing surface and said frame for biasing said trigger into a reset position after said trigger has been pulled.

A firearm comprises a frame and a trigger mounted on said frame and pivotable about a trigger pivot axis. A strut is pivotably attached to said trigger at a strut pivot axis oriented parallel to and offset from said trigger pivot axis. The strut comprises a spring bearing surface and a safety bearing surface. A spring acts between said spring bearing surface and said frame for biasing said trigger into a reset position after said trigger has been pulled. A body is mounted on said frame, said body being movable between a first position wherein said body is not engageable with said safety bearing surface, thereby allowing pivoting motion of said trigger, and a second position wherein said body is engageable with said safety bearing surface thereby limiting pivoting motion of said trigger.

In some aspects, said spring, said safety bearing surface and said body are positioned within said frame between said trigger and a muzzle end of said firearm.

A firearm comprises a frame and a trigger mounted on said frame and pivotable about a trigger pivot axis. A strut is pivotably attached to said trigger at a strut pivot axis oriented parallel to and offset from said trigger pivot axis. The strut comprises a spring bearing surface. A spring acts between said spring bearing surface and said frame for biasing said trigger into a reset position after said trigger has been pulled.

In some aspects, the strut comprises a safety bearing surface. A body is mounted on said frame, said body being movable between a first position wherein said body is not engageable with said safety bearing surface, thereby allowing pivoting motion of said trigger, and a second position wherein said body is engageable with said safety bearing surface thereby limiting pivoting motion of said trigger.

A firearm comprises a frame and a trigger mounted on said frame and pivotable about a trigger pivot axis. A strut is pivotably attached to said trigger at a strut pivot axis oriented parallel to and offset from said trigger pivot axis. The strut comprises a safety bearing surface. A body is mounted on said frame, said body being movable between a first position wherein said body is not engageable with said safety bearing surface, thereby allowing pivoting motion of said trigger, and a second position wherein said body is engageable with said safety bearing surface thereby limiting pivoting motion of said trigger.

In some aspects, the strut comprises a spring bearing surface. A spring acts between said spring bearing surface and said frame for biasing said trigger into a reset position after said trigger has been pulled.

DETAILED DESCRIPTION

Figure 1:
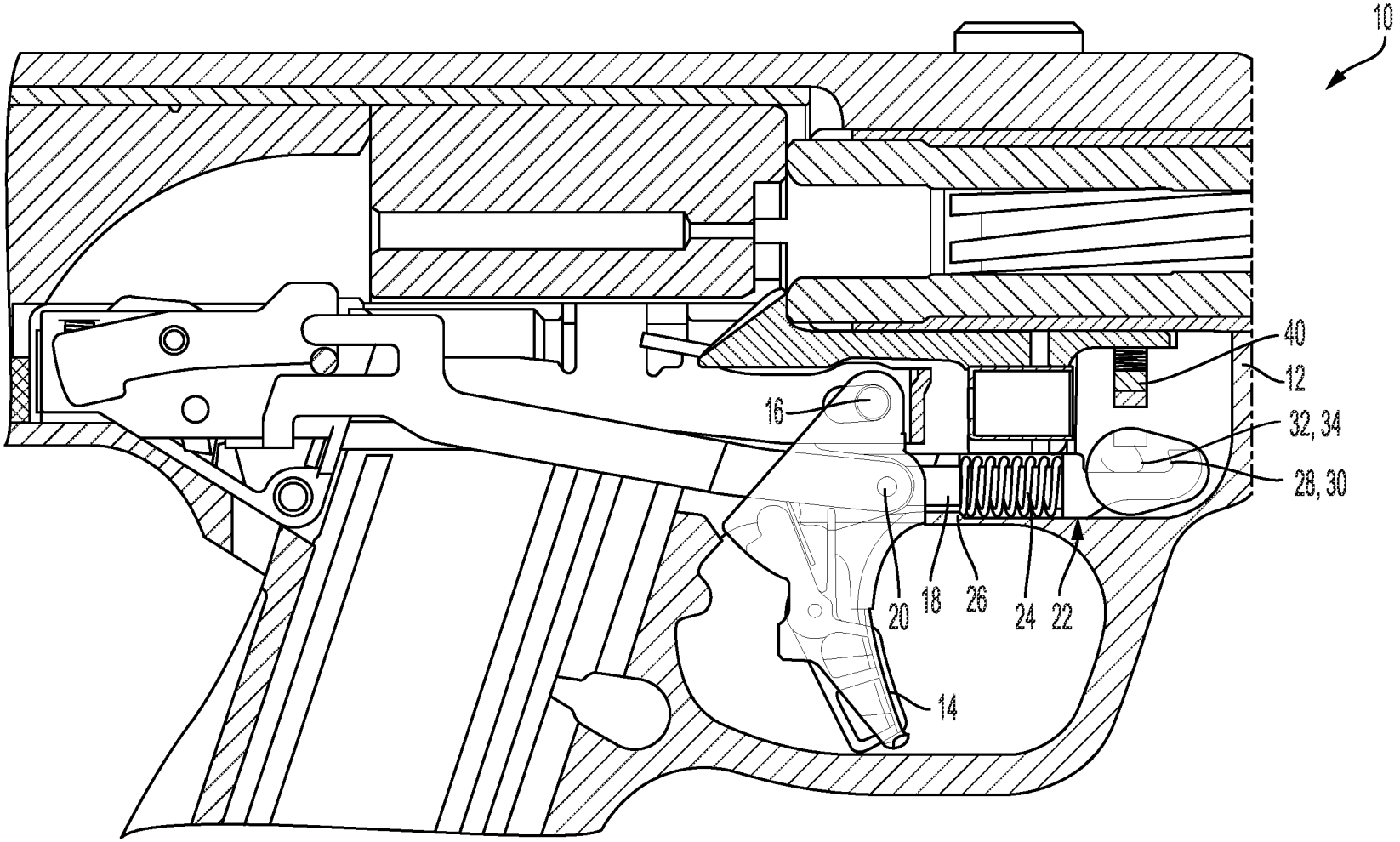
FIG. 1 shows a partial cross sectional view of an example embodiment of a firearm according to the invention having an example trigger return and an example safety mechanism according to the invention.

The invention concerns a trigger return mechanism, a safety mechanism, and a firearm having either mechanism or both mechanisms in combination. FIG. 1 shows an example firearm 10 according to the invention comprising a frame 12. A trigger 14 is mounted on the frame 12 and is pivotable about a trigger pivot axis 16. A strut 18 is slidably coupled to and, in this example, positioned within the frame 12. Strut 18 is pivotably attached to the trigger 14 at a strut pivot axis 20. The strut pivot axis 20 is oriented parallel to and offset from the trigger pivot axis 16. The strut pivot axis 20 is movable relative to the frame as the trigger is pulled.

Figure 2:
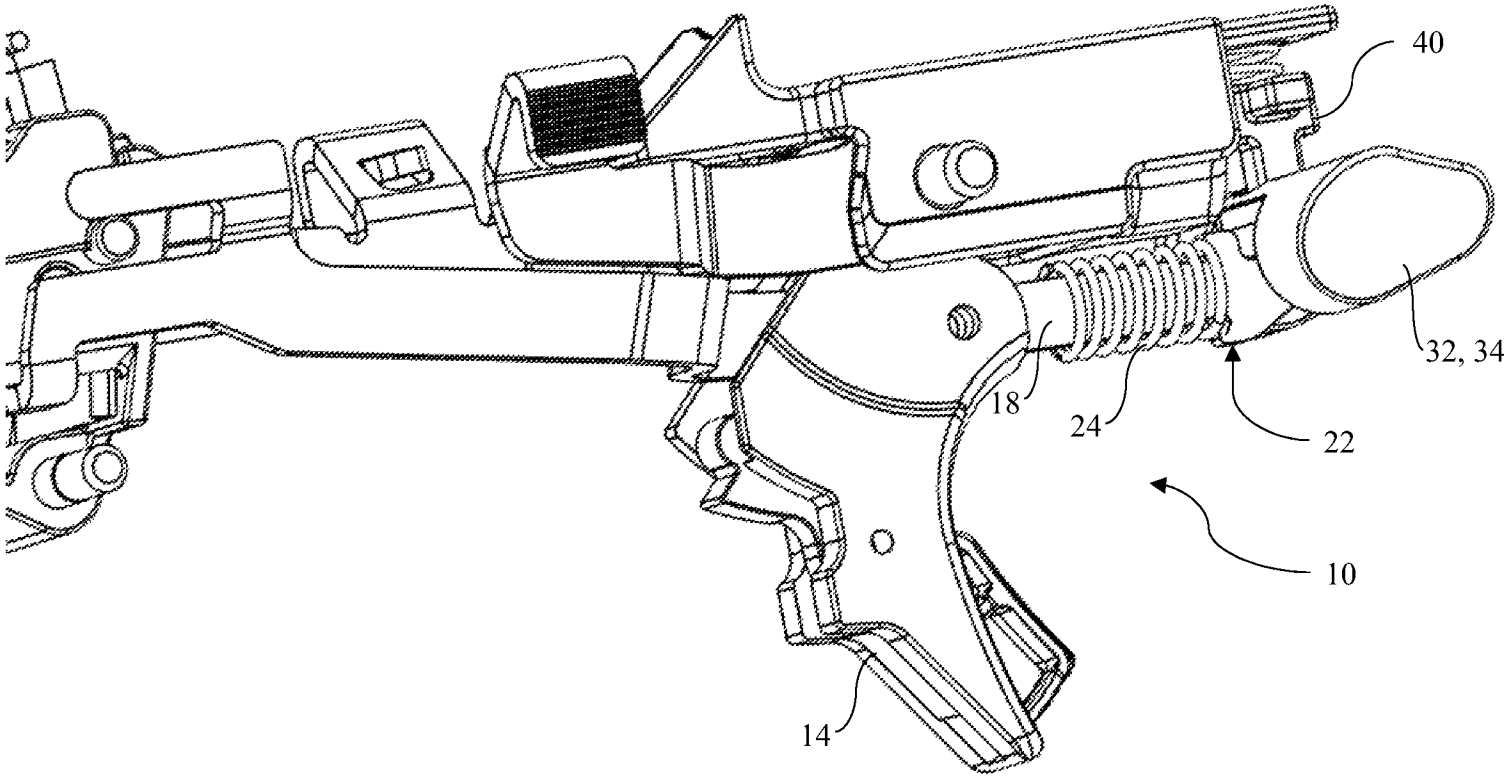
FIG. 2 shows a side perspective view of a portion of the firearm of FIG. 1, with some components omitted to show certain internal components.

Referring also to FIG. 2, the strut 18 can comprise a spring bearing surface 22. Spring bearing surface 22 may comprise a flange extending outwardly from the strut 18, for example. A spring 24 acts between the spring bearing surface 22 and the frame 12 for biasing the trigger 14 into a reset position (shown) after the trigger has been pulled. A shoulder 26, built into the frame 12, may serve as the reaction surface for the spring 24.

Figure 3:
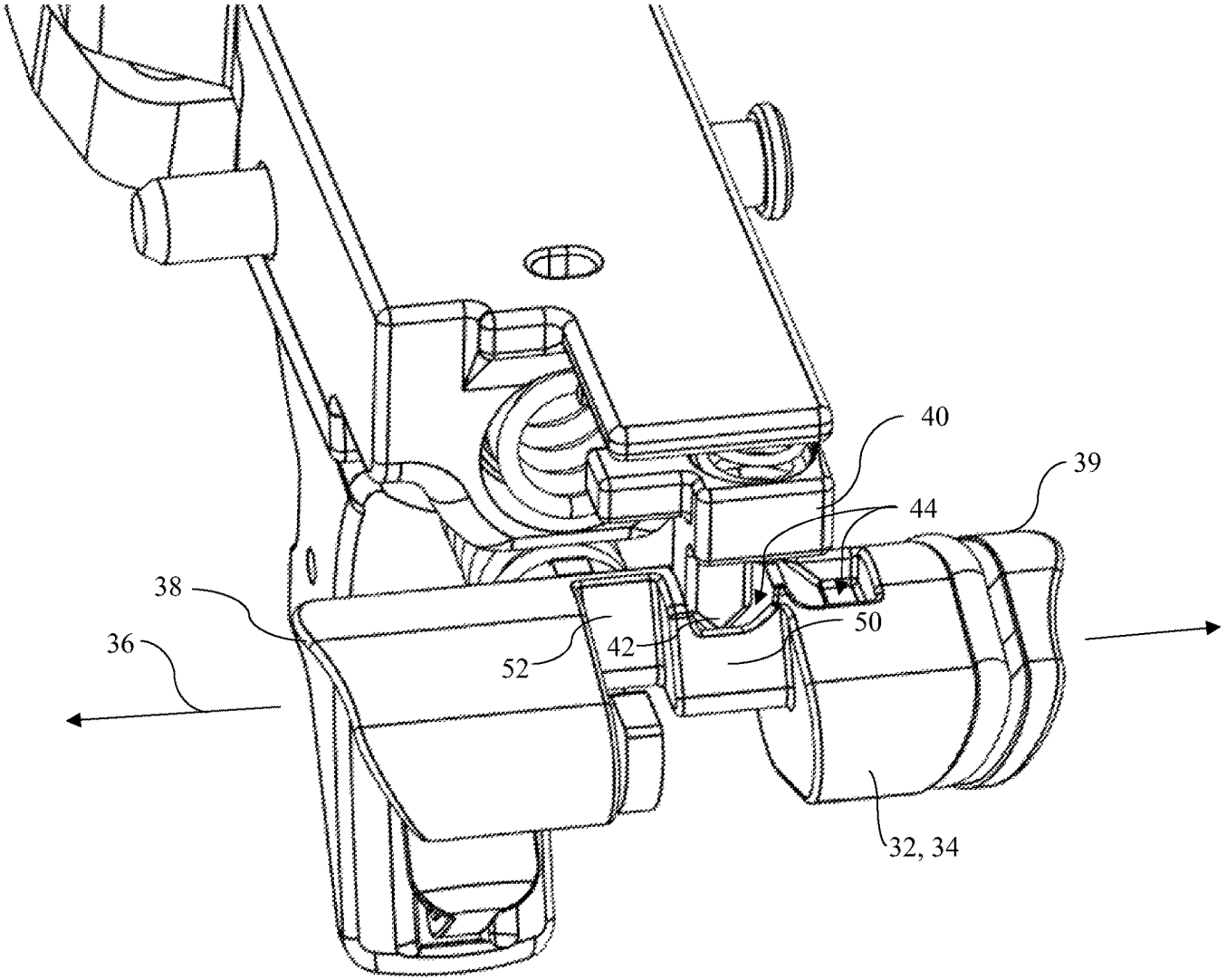
FIG. 3 shows a front perspective view of the portion of the firearm as in FIG. 2.

Referring to FIGS. 1 and 3, the strut 18 can also comprise a safety bearing surface 28. In this example embodiment the safety bearing surface 28 comprises a hook 30 positioned at the end of the strut 18. The safety actuator 32 in this example embodiment comprises a body 34 slidably coupled to the frame 12. Body 34 is movable between a first or "fire" position (shown) and a second or "safe" position. In the second (safe) position, a first surface 50 is aligned with a path of travel of safety bearing surface 28. A second surface 52 of body 34 is recessed from the first surface 50 along the path of travel of the safety bearing surface 28. In the fire position (shown), the second surface 52 is aligned with the path of travel of the safety bearing surface 28 so that the safety bearing surface 28 does not engage body 34 as the trigger 14 pivots. Accordingly, in the fire position, the body 34 is not engageable with the safety bearing surface 28 (hook 30), thereby allowing pivoting motion of the trigger 14 about the trigger pivot axis 16. In the second or "safe" position, the body 34 is engageable with the safety bearing surface 28 thereby limiting pivoting motion of the trigger 14 to prevent firing of the firearm 10. In this example embodiment, body 34 is a cross bolt type safety, wherein the body translates along an axis 36 transverse to the travel of trigger 14. When in the second (safe) position, a first portion 38 of the body 34 can project proud of (outwardly from) the surface of the frame 12 to permit manual moving of body 34 to the first (fire) position. When in the first (fire) position, a second portion 39 of the body 34 can project proud of (outwardly from) the surface of the frame 12 to permit manual moving of body 34 to the second (safe) position. A detent 40 may be used to selectively hold the body in either the first (fire) or second (safe) positions. The detent 40 can have a wedge shaped projection 42 that is receivable into respective recesses 44 of the body 34 that cooperate with the detent to retain the body in either the first (fire) or second (safe) positions. In another example a spring and ball detent may be used to selectively hold the body in either the first (fire) or second (safe) positions.

Trigger return and detent mechanisms according to the invention are useable on firearms such as handguns and long guns, in particular carbines where design considerations regarding space can be an issue.

What is claimed is:

1. In combination, a trigger return and safety mechanism mountable on a frame of a firearm, said combination comprising:

a trigger mountable on said frame and pivotable about a trigger pivot axis;

a strut positionable on said frame and pivotably attached to said trigger at a strut pivot axis oriented parallel to and offset from said trigger pivot axis, wherein said strut comprises a spring bearing surface and a safety bearing surface;

a spring acting between said spring bearing surface and said frame for biasing said trigger into a reset position after said trigger has been pulled; and a body mountable on said frame, said body being movable between a first position wherein said body is not engageable with said safety bearing surface, thereby allowing pivoting motion of said trigger, and a second position wherein said body is engageable with said safety bearing surface thereby limiting pivoting motion of said trigger.

2. The combination according to claim 1, wherein said spring, said safety bearing surface and said body are positionable within said frame between said trigger and a muzzle end of said firearm.

3. A firearm, said firearm comprising:

a frame; and said combination of said trigger return and said safety mechanism as recited in claim 1 mounted on said frame, wherein:

said trigger is mounted on said frame and pivotable about said trigger pivot axis;

said strut is pivotably attached to said trigger at said strut pivot axis;

said spring is acting between said spring bearing surface and said frame for biasing said trigger into said reset position after said trigger has been pulled; and said body is mounted on said frame, said body being movable between said first position and said second position.

4. The firearm according to claim 3, wherein said spring, said safety bearing surface and said body are positioned within said frame between said trigger and a muzzle end of said firearm.

5. A trigger return mechanism mountable on a frame of a firearm, said mechanism comprising:

a trigger mountable on said frame and pivotable about a trigger pivot axis;

a strut pivotably attached to said trigger at a strut pivot axis oriented parallel to and offset from said trigger pivot axis, wherein said strut comprises a spring bearing surface and a safety bearing surface, wherein the trigger defines a forward surface that is configured to contact a finger as the trigger is being pulled and an opposite rear surface, wherein the forward surface is spaced forwardly from the rear surface along a longitudinal axis, wherein the strut extends forwardly from the trigger along the longitudinal axis;

a spring acting between said spring bearing surface and said frame for biasing said trigger into a reset position after said trigger has been pulled and a body mountable on said frame, said body being movable between a first position wherein said body is not engageable with said safety bearing surface, thereby allowing pivoting motion of said trigger, and a second position wherein said body is engageable with said safety bearing surface thereby limiting pivoting motion of said trigger.

6. A firearm, said firearm comprising:

a frame; and said trigger return mechanism of claim 5 mounted on said frame, wherein:

said trigger is mounted on said frame and pivotable about said trigger pivot axis;

said strut is pivotably attached to said trigger at said strut pivot axis oriented parallel to and offset from said trigger pivot axis; and said spring is acting between said spring bearing surface and said frame for biasing said trigger into a reset position after said trigger has been pulled.

7. A trigger safety mechanism mountable on a frame of a firearm, said mechanism comprising:

a trigger mountable on said frame and pivotable about a trigger pivot axis;

a strut pivotably attached to said trigger at a strut pivot axis oriented parallel to and offset from said trigger pivot axis, wherein said strut comprises a safety bearing surface;

and a body mountable on said frame, said body being movable between a first position wherein said body is not engageable with said safety bearing surface, thereby allowing pivoting motion of said trigger, and a second position wherein said body is engageable with said safety bearing surface thereby limiting pivoting motion of said trigger.

8. The mechanism according to claim 7, wherein said strut comprises a spring bearing surface, wherein said mechanism further comprises:

a spring acting between said spring bearing surface and said frame for biasing said trigger into a reset position after said trigger has been pulled.

9. A firearm, said firearm comprising:

a frame;

said trigger safety mechanism of claim 7 mounted on said frame, wherein:

said trigger is mounted on said frame and pivotable about said trigger pivot axis;

said strut is pivotably attached to said trigger at said strut pivot axis oriented parallel to and offset from said trigger pivot axis; and said body is mounted on said frame, said body being movable between said first position and said second position.

10. The firearm according to claim 9, wherein said strut comprises a spring bearing surface, wherein said firearm further comprises:

a spring acting between said spring bearing surface and said frame for biasing said trigger into a reset position after said trigger has been pulled.

* * * * *